United States Patent [19]

English

[11] 4,315,629

[45] Feb. 16, 1982

[54] BI-WING FLYING DISC

[76] Inventor: Roy L. English, 2733 SE. 31st St., Portland, Oreg. 97202

[21] Appl. No.: 945,391

[22] Filed: Sep. 25, 1978

[51] Int. Cl.[3] ..... A63H 27/00

[52] U.S. Cl. ..... 273/425

[58] Field of Search ..... 273/106 B, 106 R, 425; 46/74 D

[56] References Cited

U.S. PATENT DOCUMENTS

| | | | |
|---|---|---|---|
| 2,953,378 | 9/1960 | Veigne, Jr. | 273/425 X |
| 3,580,580 | 5/1971 | Wark | 273/106 B |
| 3,724,122 | 4/1973 | Gillespie | 273/106 B X |
| 3,765,122 | 10/1973 | English | 273/106 B X |
| 3,828,466 | 8/1974 | Geiger | 273/106 B X |
| 3,939,602 | 2/1976 | Burke et al. | 46/74 D |
| 4,045,029 | 8/1977 | Katzmark | 273/425 |
| 4,104,822 | 8/1978 | Rodgers | 273/425 X |
| 4,182,073 | 1/1980 | Tabet | 46/74 D |

FOREIGN PATENT DOCUMENTS

| | | | |
|---|---|---|---|
| 2246469 | 3/1973 | Fed. Rep. of Germany | 46/74 D |
| 416687 | 9/1934 | United Kingdom | 273/425 |

*Primary Examiner*—Paul E. Shapiro

*Attorney, Agent, or Firm*—Christie, Parker & Hale

[57] ABSTRACT

A flying disc with a central opening utilizing a plurality of concentrically arranged annular sections with at least the innermost ring having a unique sloping surface resulting in improved stability in flight. In the two annular section version of the disc, it is comprised of an outer annular, lifting surface concentrically surrounding and connected to an inner annular ring by a series of struts providing a circular pattern of slots between the two sections. The inner annular ring is shaped to incorporate a continuous dihedral angle between the inner and outer edges of the inner ring that provides great lateral stability in all flight attitudes.

23 Claims, 13 Drawing Figures

BI-WING FLYING DISC

DESCRIPTION OF THE PRIOR ART

The present invention relates to throwing discs and, in particular, to a disc utilizing two or more concentrically-arranged rings, with at least the innermost ring presenting a continuous dihedral angle to the airstream flowing over the disc.

Catching and throwing discs have been a particularly well-received type of game and sporting goods article, as well as toy and novelty implement for approximately the past twenty years. Beginning at least with the disclosure of a disc in U.S. Pat. No. Des. 183,626, an enthusiasm concerning this article has grown up which is quite unparalled. The disc shown in U.S. Pat. No. Des. 183,626, was first marketed on a large scale under the trademark FRISBEE and has, by now, become extremely well-known. The flight characteristics of the disc of this design patent were further improved upon as disclosed in U.S. Pat. No. 3,359,462, in which modifications were provided which served to improve the aerodynamics of the disc significantly.

The disc of the two foregoing patents was a unitary structure consisting of a solid, continuous upper surface of uniform cross-section bounded by a downwardly-turned, downwardly-extending rim of greater cross-sectional thickness than the central portion. In general, the configuration was such that the central portion in conjunction with the rim was characterized by a convex upper surface and a concave under or lower surface. Throwing of the disc was accomplished by grasping the disc with the fingers and bracing the thumb against the rim to launch the disc with a wrist-snapping, arm-swinging motion.

In addition to closed or domed discs of the kind described above, hand-launched gliders of the so-called "ring" type have also been utilized. Such gliders had configurations of various forms. In one instance, the devices comprised a band or ring defining a center opening with the inner and outer edges of the ring having a predetermined relationship to each other. The annular body section of the ring, likewise, had a structure of a specified configuration. Typical of the patents of this type are U.S. Pat. Nos. 3,580,580 and 3,765,122. In the devices of the foregoing patents, the band or ring is relatively narrow and the central opening is relatively large.

In other configurations, the central opening is relatively small and the device approaches the type described previously, namely, the domed or dished flying saucer. Typical of this particular type of saucer is the disc of U.S. Pat. No. 4,045,029 which is a thin disc having an outer annular area upwardly convex and an inner annular area which slopes downwardly toward the disc axis to define a circular central opening. Here, the radius of the opening may vary from very small to one which is approximately one-half ($\frac{1}{2}$) of the radius of the complete disc. In contrast with the ring of the U.S. Pat. No. 3,580,580, the radius of the circular central opening is significantly in excess of one-half ($\frac{1}{2}$) the radius of the overall disc.

Another type of disc is one which includes the provision of struts or vanes bridging a circular central opening and extending in a generally radial pattern from a centrally-disposed object. The discs of the U.S. Pat. No. Des. 241,565, as well as U.S. Pat. No. 4,045,029, are examples of discs of this type. The disc of U.S. Pat. No. 3,742,643 is also representative.

Still another variation of ring-type discs provide a composite structure utilizing a ring having a circular central opening supporting a smaller element of a circular configuration disposed concentrically of the ring and displaced from the plane of the ring. This second element is generally a disc-type of element and is of a radius smaller than the radius of the ring. It is disposed above and parallel to the plane of the underlying ring by means of a plurality of struts or fins. A device of this type is shown in U.S. Pat. No. 3,939,602. As described therein, the outer ring and the upper disc portion are generally thin and flat in configuration. In some variations with gliders of this type, the lower outer ring is provided with a rim comprising a depending cylindrical flange that performs a number of functions, including stabilization of the flight of the toy and providing a better grip for the user.

SUMMARY OF THE PRESENT INVENTION

The present invention provides an improved configuration of the ring-type of flying disc or glider. According to the present invention, this configuration comprises at an outer and at least one inner ring sloping inwardly at a predetermined angle, concentrically arranged and connected by spaced struts to the outer ring which defines a pattern of slots extending around the disc intermediate its inner and outer peripheries.

The present invention provides an aerodynamic flying disc comprising a first outer annulus having a first outer and inner circumference, said first outer annulus defining an aerodynamic lifting surface. At least one inner annulus located interiorly of a cylindrical envelope defined by the inner circumference of the first annulus is provided, said inner annulus having a second circumference smaller than said first inner circumference and defining a central opening located in a plane intermediate the elevation of the highest and lowest point of the disc for the passage of air therethrough. The inner annulus is configured such that the radially outermost edge thereof is located at an elevation above the lowest portion of the inner annulus. A surface of revolution is located between the inner and outer annulus with the surface of revolution interconnecting the inner and outer annulus. Finally, a plurality of apertures are provided in the surface of revolution between the inner and outer annulus such that the surface of revolution defines a plurality of individual circumferentially directed rigid support means interconnecting the inner and outer annulus.

The invention also provides an aerial disc comprising a circular ring having a predetermined width and an aerodynamic profile in section. The ring has an outer diameter defining an outer rim and an inner diameter defining an inner rim and a central aperture opening from both sides of the disc. The central aperture is located in a plane at an elevation intermediate the elevation of the highest and lowest point of the disc. A plurality of secondary openings are spaced around the ring intermediate the central opening and the outer rim with said secondary and central openings being arranged to permit the free passage of air therethrough when the disc is in flight. The ring has at least one circular generally planar section located intermediate said secondary openings and the inner rim. The inner rim is displaced in the axial direction to an elevation below the planar section whereby the portion of the disc intermediate the secondary openings and the central opening defines a positive dihedral angle.

In overall configuration, what is provided is an aerial disc characterized by a ring configuration and a central opening. The ring comprises two or more annular portions decreasing in diameter radially toward the center of the disc. Interior ring portions are supported on and integrally connected to the outer ring portions by struts or fairings. In a presently preferred embodiment, an inner ring is displaced axially to a position above the preceding outer ring or rings. By virtue of controlling the width dimension of the supports or struts, the net effect is to create slots between adjacent rings. Depending on the configuration of the struts, the slots are radially or circumferentially oriented. The slots have significance with respect to the overall flight characteristics of the discs.

DESCRIPTION OF THE DRAWINGS

These and other advantages of the present invention will be better understood by reference to the drawing wherein.

DESCRIPTION OF A SPECIFIC EMBODIMENT

Figure 1:
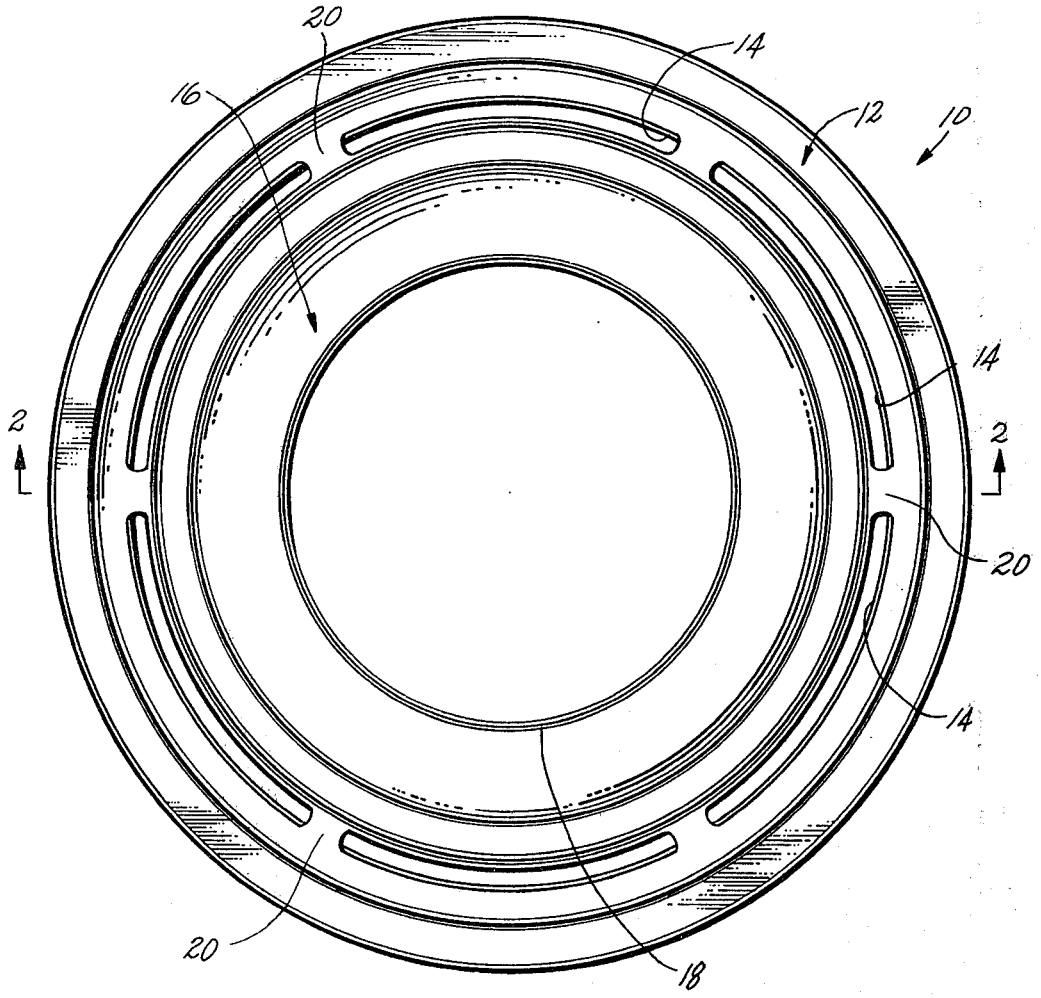
FIG. 1 is a plan view of the disc according to the present invention.
Figure 2:
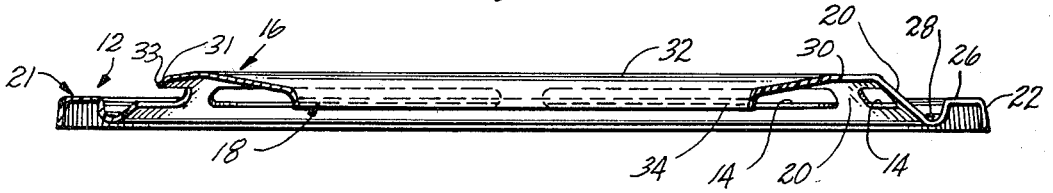
FIG. 2 is a sectional view taken along the lines 2—2 of FIG. 1.

The presently preferred embodiment of the disc of the present invention is shown in plan view in FIG. 1 and sectional view in FIG. 2. The invention comprises a disc 10 having an outer annular portion 12 and an inner annular portion 16. Connecting the inner and outer annular portions or rings 12,16 are a plurality of tab support elements or struts 20 which extend between the inner periphery of the outer annular portion and the outer periphery of the inner annular portion. The struts 20 are spaced around the circumference of the disc so as to define a plurality of arcuate slots 14 extending around the entire disc.

As is best illustrated in FIG. 2, the outer annular portion 12 comprises a rim portion 21 and an interiorly-located trough portion 28. The rim portion includes a downwardly depending rim 22 and a flat upper portion 26 integrally-formed with rim portion 22 at its outer extremity and extending interiorly thereof and integrally-formed with trough portion 28 at its inner extremity. The trough portion terminates the outer ring 12 at the point of juncture with struts 20 and thereby defines an annular channel extending around the entire disc spaced interiorly from the outer periphery of the disc by the width of the rim portion.

Attached to the outer annular portion 12 is the inner annular portion 16 which, as shown in FIG. 2 is displaced axially with respect to the plane of outer portion 12 in an upward direction above the plane of portion 12. In configuration, the inner annular portion 16 comprises a generally flat, upper surface portion 30 having a downwardly depending flange portion 31 extending radially outwardly from surface 30 which is integrally-formed with struts 20. Surface 30 is joined at its interior periphery by a canted surface 32 which extends downwardly and inwardly toward the center of the disc and terminates in an inner rim 18. The inner annular portion is configured such that the outer edge 33 of flange 31 is positioned at an elevation axially higher than the elevation of the inner edge 34 of inner rim 18. In cross-section, a plan defined by the inner and outer edges 33,34 intersect a horizontal plane defined by inner edge 34 to form a positive dihedral angle. The circular configuration of the disc thus results, in effect, in a "continuous" positive dihedral angle as the thrown disc rotates in flight, contributing significantly to the increased stability obtained by the disc of the present invention.

Figure 3:
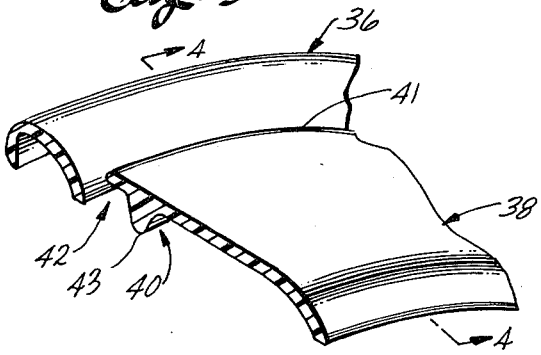
FIG. 3 is a perspective view of an alternate embodiment of the disc according to the present invention.
Figure 4:
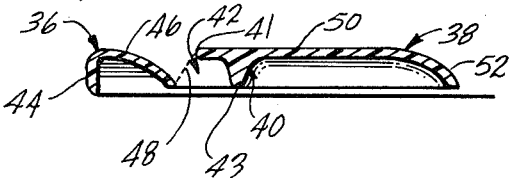
FIG. 4 is a cross-sectional view taken along the lines 4—4 of FIG. 3.

An alternate embodiment of the double-ring disc of the present invention is shown in FIGS. 3 and 4 being, respectively, a perspective sectional view of said alternate embodiment and a sectional view in elevation of the disc of FIG. 3 taken along lines 4—4 thereof. As shown therein, the slotted disc comprises an outer ring 36 and an inner ring 38. Inner ring has a downwardly depending leg 40 integrally formed with the inner ring and spaced generally adjacent a slot 42 defined between the two rings. As seen in FIGS. 3 and 4, outer ring 36 comprises a downwardly depending rim portion 44 and an arched portion 46 integrally formed with the rim portion and extending interiorly toward the center of the disc. A tab support or strut 48 is shown in ghosted illustration in FIG. 4 depicting the means whereby the inner ring 38 is connected to and supported by the outer ring 36.

Inner ring 38 comprises a generally horizontal planar surface 50 integrally formed with tabs 48 and extending interiorly from slots 42 to a downwardly curved portion 52 defining the inner periphery of the disc. As seen in FIG. 4, inner ring 38 is also displaced axially to a position such that the plane defined by the bottom of ring 38 is slightly elevated with respect to the plane defined by the bottom of ring 36. Leg 40 acts as a deflecting surface for the flow of air passing through slot 42 as the disc is flown through the air. The plane defined by the outer edge 41 of inner ring 38 and the bottom edge 43 of leg 40 intersects a horizontal plane defined by bottom edge 43, resulting in the positive, continuous dihedral angle provided by the inner annular ring.

Figure 5A:
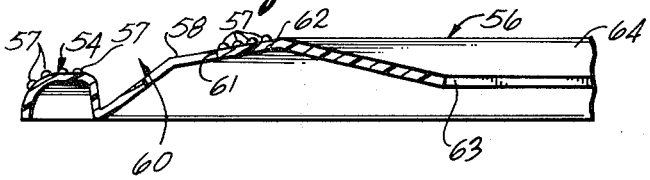
FIG. 5A is a cross sectional view of an alternate embodiment of the disc of the present invention.
Figure 5B:
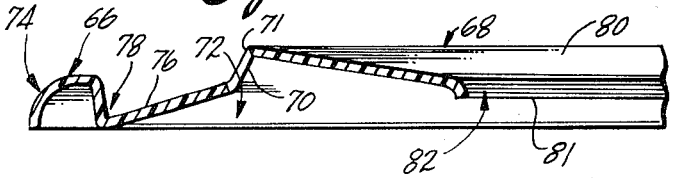
FIG. 5B is a cross-sectional view of still another alternate embodiment of the disc of the present invention.
Figure 5C:
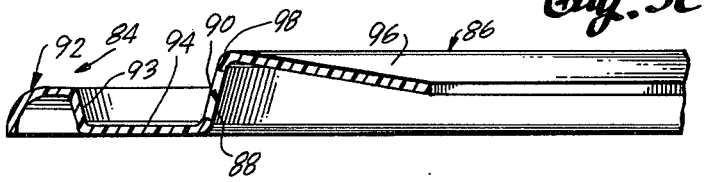
FIG. 5C is a cross-sectional view of still another alternate embodiment of the disc.

Cross-sectional views in FIGS. 5A, 5B, and 5C illustrate still additional alternate embodiments of the disc of the present invention. As seen therein, the embodiment in FIG. 5A comprises an outer ring 54 and an inner ring 56 joined to the outer ring by means of struts 58. Arcuate slots 60, extending around the disc between inner and outer rings 54,56, are located between struts 58. The disc of FIG. 5A has a generally domed shaped configuration in comparison to the disc of FIGS. 3 and 4. In this embodiment, the outer ring 54 has an angular configuration, as does the inner ring 56. In the embodiment of FIG. 5A, the inner ring 56 consists of a first inclined surface 62 which is canted downwardly and outwardly toward outer ring portion 54 and a second inclined surface 64 canted downwardly and inwardly toward the interior central opening of the disc. An outer edge 61 of surface 62, together with an inner edge 63 of surface 64, define a plane providing the positive dihedral angle for this embodiment of the disc of the present invention. Small raised ridges 57 on rings 54,56, enhance the aerodynamics of the disc.

The embodiment of FIG. 5B comprises an outer ring 66 and an inner ring 68 attached to the outer ring by tab supports 70, which are spaced around the periphery of the disc to define slots 72. In this embodiment, the outer ring 66 comprises a rim portion 74 integrally formed with an upwardly canted surface 76 which defines a trough or channel generally indicated at 78 extending around the circumference of the saucer. Inner ring 68 comprises an inwardly canted, generally planar surface 80 terminating in a downwardly depending rim or bead 82. The outer edge 71 of surface 80, together with the inner edge 81 of rim 82, defines a positive dihedral angle with respect to a horizontal plane defined by rim 82.

The disc of FIG. 5C comprises an outer ring 84 and an inner ring 86 which is joined to the outer ring 84 by means of tabs or struts 88 located at spaced intervals around the disc to define slots 90. In this embodiment, the outer ring 84 of the disc has an arcuately-shaped rim portion 92, a sharply canted, downwardly extending surface 93, integrally formed and located interiorly of rim portion 92, and an inwardly-extending, horizontal surface 94 defining a flat channel extending around the entire circumference of the disc. The inner ring 86 comprises an inwardly canted surface 96 having a flange 98 formed at the outer periphery thereof which is integrally-formed with the tabs 88 such that the slots 90 are located in a generally vertical orientation in the structure defining the boundary between the inner and outer rings. The outer edge 99 of flange 98 together with the interior edge 97 of surface 96 provides the continuous positive dihedral angle configuration of this embodiment of the disc.

Figure 6:
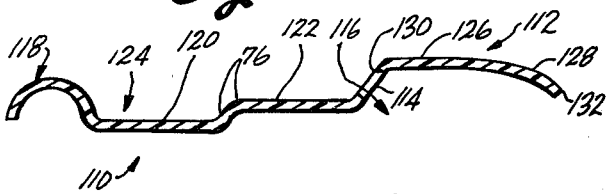
FIG. 6 is a cross-sectional view of another alternate embodiment of the disc having a generally planar innermost annular portion.

The disc shown in FIG. 6 illustrates a low profile disc according to the present invention. As shown therein, the disc comprises an outer ring 110 and an inner ring 112 attached to the outer ring by tab supports 114 which are spaced around the periphery of the disc to define slots 116. In this embodiment, outer ring 110 comprises a convex rim portion 118, a first intermediate surface 120 and a second intermediate surface 122 stepped up in elevation slightly above the elevation of surface 120. The rim portion 118 intermediate surface 120, and intermediate surface 122 are integrally formed with each other and with tabs 114. The configuration of the outer ring 110, thus, defines a first trough or channel generally indicated at 124 extending around the circumference of the saucer which is integrally formed with a slightly elevated shelf defined by surface 122 located radially interiorly of surface 120 likewise extending around the circumference of the saucer. The inner ring 112 comprises a horizontal surface 126 and a downwardly curved inner rim portion 128. Surface 126 terminates in edge 130 and rim portion 128 terminates in edge 132. The plane defined by edges 130, 132 defines the positive dihedral angle for this embodiment of the disc.

Figure 7A:
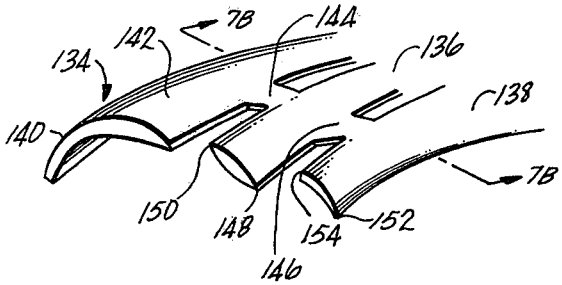
FIG. 7A is a perspective of an alternate embodiment of the disc of the present invention having three concentric annular sections.
Figure 7B:
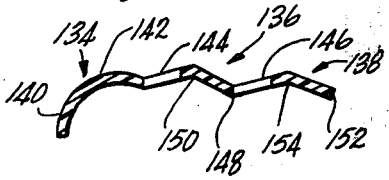
FIG. 7B is a cross-sectional view taken along lines 7B—7B of FIG. 7A.

The embodiments of the disc described heretofore comprise double ring designs consisting primarily of an inner and outer ring wherein the outer ring defines an aerodynamic surface and the inner ring a structure of predetermined configuration defining a positive dihedral angle. The embodiment shown in FIGS. 7A and 7B is a triple ring disc comprising an outer ring 134, an intermediate ring 136 and an interior ring 138. As shown in FIGS. 7A and 7B ring 134 comprises an arcuately shaped configuration having a downwardly depending rim 140 and a generally horizontal surface 142 extending radially interiorly from rim 140. Annular portion 134 is joined to annular portion 136 by means of struts 144. Likewise, annular portion 136 is joined to interior annular portion 138 by struts 146. The inner edge 148 of annular portion 136, is located at an elevation lower than the elevation of outer edge 150 providing a first continuous positive dihedral angle located interiorly of the exterior aerodynamically shaped ring 134. Likewise, the inner edge 152 of inner annular portion 138 is located at an elevation below the elevation of outer edge 154 to define a second interior positive dihedral angle. The triple ring disc of FIGS. 7A, 7B is illustrative of a large number of conventionally arranged annular portions combined to provide a disc according to the present invention with one or more of the interior rings being provided with a positive dihedral angle.

Figure 8A:
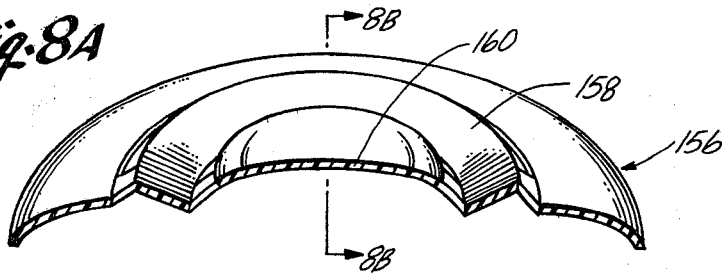
FIG. 8A is a perspective view of an embodiment of the present invention having an inverted closed saucer located in the center of the disc.
Figure 8B:
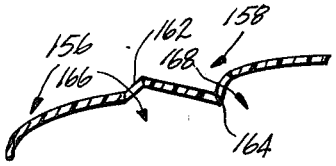
FIG. 8B is a cross-sectional view taken along lines 8B—8B of FIG. 8A.

The disc shown in FIGS. 8A and B illustrates a disc according to the present invention having a closed inverted saucer located in the normally open central portion of the disc. As shown therein, the disc comprises an outer annular portion 156 comprising an aerodynamic lifting surface, an inner annular portion 158 having the configuration of a positive dihedral angle and a closed inverted saucer 160 such as that disclosed in U.S. Pat. No. 3,359,768. Struts 162 are integrally formed with and interconnect outer annular portion 156 and inner annular portion 158. Similarly, struts 164 interconnect inner annular portion 158 and disc 160. The configuration thus defines a structure similar to that illustrated in FIGS. 7A and 7B, namely a disc configuration having a first set of slots 166 located between the first and second annular portions 156, 158 and a second set of slots 168 located between inner annular portion 158 and disc 160. The disc of FIGS. 8A and 8B thus combines the aerodynamic performance of the inverted flying saucer type of disc such as that shown in U.S. Pat. No. 3,359,462 and the double ring disc of the present invention.

Figure 9:
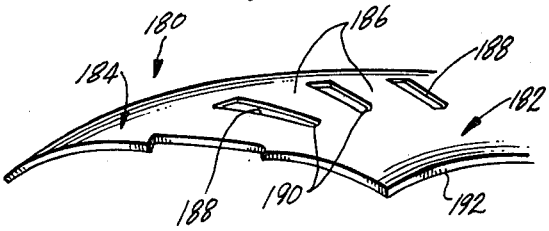
FIG. 9 is a perspective view of an alternate embodiment of the disc having a plurality of radially oriented slots located between inner and outer annular sections of the disc.

Still another embodiment of the disc according to the present invention is shown in FIG. 9. As shown therein, the disc 180 comprises an inner annular portion 182 and an outer annular portion 184 joined together by means of flat supports or struts 186 which are relatively wide, flat horizontal surfaces. The wide, flat interconnecting supports or struts 186 thereby define radially extending slots 188 in contrast to the circumferentially extending slots shown in the previous embodiments. Inner annular portion 182 is configured such that the radially interiormost portion 190 of slots 188 is disposed at an elevation higher than the interior edge 192 of annular portion 182 to thereby provide the continuous positive dihedral angle characteristic of the present invention.

In essence, the disc achieves long distance, easily controlled, stable flight by virtue of the rings deflecting air downwardly at the leading edge of the disc to provide aerodynamic lift at that point. The configuration of the outer rings being generally in the shape of air foils, produces a deflection of air over the top of the outer ring through the slots of the saucer to the underside of the disc to provide an initial increment of lift. The deflected air passing beneath the inner and outer rings at the trailing edge of the disc also provides lift. In comparison to discs of the prior art, the disc of the present invention is characterized by a flight of exceptionally long distance with routine unskilled throws. Flight paths of in excess of eighty (80) feet are normal, even for users relatively uninitiated to the art of throwing discs. The disc has the additional advantage that, because of its very high degree of aerodynamic stability, it tends to stabilize itself in flight, despite the fact that it may have been poorly or incorrectly thrown. Thus, the enjoyment of this type of sport can be quickly and easily realized by even completely inexperienced throwers. This quickly develops confidence and enables the user to learn to throw the disc very successfully over long distances and with great accuracy with relatively little practice. The stability of the disc in flight is further enhanced by the fact that the slots provide for an avenue of escape of air as the disc slows down toward the end of its flight and begins to settle toward the ground. If the disc is tilted, the escape of air through the slots is increased at the upwardly tilted side, whereas, at the downwardly tilted side, the reverse is true and the differential in pressure thus acts to stabilize the disc in flight, causing it to settle toward the ground in a level plane as it slows down.

What is claimed is:

1. A flying disc comprising:

a first outer annulus haing a first outer and inner circumference, said first outer annulus defining an aerodynamic lifting surface;

at least one inner annulus located interiorly of a cylindrical envelope defined by the inner circumference of the first annulus, said inner annulus having a second circumference smaller than said first inner circumference and defining a central opening located in a plane intermediate the elevation of the highest and lowest point of the disc for the passage of air therethrough, said inner annulus being configured such that the radially outermost edge thereof is located at an elevation above the lowest portion of said inner annulus;

a surface of revolution located between the inner and outer annulus, said surface of revolution interconnecting the inner and outer annulus; and a plurality of apertures in the surface of revolution between the inner and outer annulus such that the surface of revolution defines a plurality of individual circumferentially directed rigid support means interconnecting the inner and outer annulus.

2. A disc according to claim 1 wherein the inner annulus defines, in cross-section, a dihedral angle.

3. A disc according to claim 2 wherein the lowest portion of the inner annulus is the radially innermost edge.

4. A disc according to claim 2 wherein the lowest portion of the inner annulus is located intermediate the radially outermost and innermost edges thereof.

5. A disc according to claim 4 wherein said lowest portion is an annular downwardly extending leg formed into the downwardly facing surface of said inner annulus, said leg portion being located closer to the radially outermost edge of said inner annulus than to the radially innermost edge thereof.

6. A disc according to claim 2 wherein the inner annulus is generally planar and the radially innermost edge thereof is downwardly turned.

7. A disc according to claim 6 wherein the radially outermost edge of the inner annulus is downwardly turned.

8. A disc according to claim 7 wherein the portion of the inner annulus intermediate the radially outermost and innermost edges is formed into two generally planar inclined surfaces, said first surface being inclined upwardly from the radially outermost edge, said second surface being inclined upwardly from said radially innermost edge.

9. A disc according to claim 8 wherein the line of contact between the two generally inclined planar surfaces is the line of highest elevation of the disc.

10. A disc according to claim 1 wherein the support means interconnecting the inner and outer annuli lie along a predetermined number of radii extending from the center of the disc.

11. A disc according to claim 10 wherein the support means define a plurality of elongated radially extending slots spaced circumferentially around the disc intermediate its outer and inner edges.

12. A disc according to claim 10 wherein the support means depend downwardly from the outermost edge of the inner annulus and the circumferential slots face radially outwardly.

13. A disc according to claim 10 wherein the support means define a plurality of elongated arcuate slots spaced circumferentially around the disc intermediate its outer and inner edges.

14. A disc according to claim 1 wherein the inner annulus is positioned at an elevation such that the elevation of the radially outermost edge of the inner annulus is higher than any point on the outer annulus.

15. A disc according to claim 1 wherein the outer annulus has a downwardly depending rim portion located at the radially outermost edge of said outer portion and an annular trough shaped portion located interiorly of said rim portion.

16. A disc according to claim 15 including an aerodynamically shaped surface interconnecting the rim and trough portions.

17. An aerial disc comprising:

a circular ring having a predetermined width and an aerodynamic profile in section, said ring having an outer diameter defining an outer rim and an inner diameter defining an inner rim and a central aperture opening from both sides of the disc, said central opening being located in a plane at an elevation intermediate the elevation of the highest and lowest point of the disc; and a plurality of secondary openings spaced around the ring intermediate the central opening and the outer rim, said secondary and central openings being arranged to permit the free passage of air therethrough when the disc is in flight, said ring having at least one circular generally planar section located intermediate said secondary openings and the inner rim, the inner rim being displaced in the axial direction to an elevation below the planar section whereby the portion of the disc intermediate the secondary openings and the central opening defines a positive dihedral angle.

18. A disc according to claim 17 wherein said secondary openings are radially extending slots lying along predetermined radii extending outwardly from the center of the disc.

19. A disc according to claim 18 wherein said slots are elongated, the axis of elongation of said slots lying along said predetermined radii.

20. A disc according to claim 17 wherein said secondary openings are arcuately extending slots extending around the disc intermediate the central opening and the rim.

21. A disc according to claim 20 wherein said slots are elongated, the axis of elongation of said slots lying along an arc located at a predetermined distance from the center of the disc.

22. A disc according to claim 17 including an annular leg formed in the underside of and extending around the disc, the leg being located on the portion of the disc located interiorly of the secondary openings adjacent the secondary openings.

23. A flying disc comprising:

a first outer annulus having a first outer and inner circumference, said first outer annulus defining an aerodynamic lifting surface;

at least one inner annulus located interiorly of a cylindrical envelope defined by the inner circumference of the first annulus, said inner annulus having a second circumference smaller than said first inner circumference and a central opening for the passage of air therethrough, said central opening being located in a plane at an elevation intermediate the elevation of the highest and lowest point of the disc, said inner annulus being configured such that the radially outermost edge thereof is located at an elevation above the lowest portion of said inner annulus;

a surface of revolution located between the inner and outer annulus, said surface of revolution interconnecting the inner and outer annulus; and a plurality of apertures in the surface of revolution between the inner and outer annulus such that the surface of revolution defines a plurality of individual radially directed rigid support means interconnecting the inner and outer annulus.

* * * * *